United States Patent [19]

Katchko et al.

[11] Patent Number: 4,797,176

[45] Date of Patent: Jan. 10, 1989

[54] THERMOSETTING SIZE PRESS COMPOSITION

[75] Inventors: John E. Katchko, Barrington; Charles W. Strobel, Schaumburg; Thomas H. Plaisance, Wilmette, all of Ill.

[73] Assignee: DeSoto, Inc., Des Plaines, Ill.

[21] Appl. No.: 83,166

[22] Filed: Aug. 10, 1987

[51] Int. Cl.[4] ..... D21H 3/36

[52] U.S. Cl. ..... 162/135; 162/136; 162/137; 162/166; 162/167; 162/168.1; 162/181.1; 162/181.8; 428/511; 428/530; 525/58; 525/162

[58] Field of Search ..... 162/166, 167, 181, 168.1, 162/168.2, 135, 136, 137, 181.8; 525/58, 162; 428/530, 503, 511

[56] References Cited

U.S. PATENT DOCUMENTS 2,790,735 4/1957 McLaughlin et al. ..... 162/168.1

2,982,682 5/1961 Matlin ..... 162/168.1

3,878,038 4/1975 Opderbeck et al. ..... 162/168.1

*Primary Examiner*—Peter Chin

*Attorney, Agent, or Firm*—Dressler, Goldsmith, Shore, Sutker & Milnamow, Ltd.

[57] ABSTRACT

A thermosetting size applyable to paper in a size press and curable at a temperature not in excess of about 280° F. for 10 seconds is disclosed. This size comprises an aqueous emulsion comprising water having suspended therein aqueous emulsion copolymer particles of monoethylenically unsaturated monomers comprising hydroxy-functional monomer having an hydroxy number of at least about 20, and the balance of the monomers provides a water insoluble polymer having a glass transition temperature of from about −20° C. to about 50° C. The emulsion has a pH greater than about 2.5, preferably from 4.0 to 7.0, and a stoichiometric deficiency of an aminoplast cross-linking agent is used for cure. An acid curing catalyst is uniformly distributed in the size to speed the cure.

22 Claims, No Drawings

THERMOSETTING SIZE PRESS COMPOSITION

DESCRIPTION

1. Technical Field

This invention relates to thermosetting size press compositions which are adapted to be applied to paper in the size press and to cure upon exposure to the normal conditions to which sized paper is exposed to remove the water applied in the size composition. The paper with the thermoset size thereon is particularly adapted to receive release coatings. This invention includes the new size compositions, the sized paper and the release-coated sized paper in which the release coating is strongly adhered to the cured thermoset size.

2. Background Art

Release-coated paper is in common use today, but direct application of the release coating to the paper is difficult because the release coating composition penetrates the paper which wastes large amounts of the expensive release coating composition in filling the porosities of the paper. Efforts have been made to precoat the paper substrate to provide a better barrier against penetration by the release composition. These efforts are illustrated by U.S. Pat. No. 4,609,589 granted Sept. 2, 1987 to Yukio Hosoda et al in which the release layer is deposited upon an undercoating formed from a mixture of a soap-free type acrylic resin emulsion and oxidized starch. There is no indication in this patent that application and cure can take place under the limited parameters of drying which are employed in in-line size press application of coating compositions, and such conditions are normally too low in temperature and too brief in time to enable an adequate cure of the applied materials.

DISCLOSURE OF INVENTION

In accordance with this invention, a thermosetting size applyable to paper in a size press and curable at a temperature not in excess of about 280° F. for 10 seconds comprises water having suspended therein aqueous emulsion copolymer particles of monoethylenically unsaturated monomers comprising hydroxy-functional monomer having an hydroxy number of at least about 20, and the balance of the monomers providing a water insoluble polymer having a glass transition temperature of from about −20° C. to about 50° C. This emulsion has a pH greater than about 2.5, preferably at least about 3.0, and a stoichiometric deficiency of an aminoplast cross-linking agent is used so that the cured films will be hydroxy functional. An acid curing catalyst is uniformly distributed in the size to speed the cure.

The pH of the emulsion is important. Below pH 2.5, the emulsions are poorly stable. At about pH 3.0, stability becomes more satisfactory and improves further with increasing pH. While the upper pH limit is not critical, it is preferred to avoid a pH above 7.0 since at high pH too much acid catalyst is needed for rapid cure.

It is important that the cured film be hydroxy-functional. This is because it is the hydroxy functionality in the cured film which enable the subsequently applied release coat to adhere. It is not necessary to measure the hydroxy functionality since this is determined by the equivalent ratio of hydroxy groups supplied by the emulsion copolymer and the groups reactive with hydroxy which are supplied by the curing agent, e.g., the N-methylol groups in the aminoplast resin. Thus, one would use a ratio of hydroxy groups to curing groups of from 4:1 to 1.2:1, preferably from 2.5:1 to 1.5:1. In normal practice the emulsion copolymer particles will have an hydroxy number of at least about 70, and the curing agent is used in an amount which, when fully reacted, retains an hydroxy number of at least about 35.

As will be appreciated, large amounts of acid catalysts can be added to speed the aminoplast resin cure and thus provide the rapid cure needed to enable the normal drying portion of an in-line size press operation to produce a solvent resistant finish. However, excessive amounts of these acid catalysts (more than about 25% of the weight of the aminoplast curing agent) reduces the desired barrier properties, so their use is preferably minimized in this invention to less than about 20% of the weight of the aminoplast curing agent.

The desired emulsion acidity is best provided by carrying out the emulsion copolymer process using a redox polymerization in such manner that the polymerization itself directly provides the desired acidity. It is also possible for the copolymer itself to contain a small proportion of some acidic monomer, like acrylic or methacrylic acid, to provide in whole or in part the desired emulsion acidity. In such instance, the copolymerization need not be carried out with a redox catalyst system, and other catalyst systems are known. Adequate emulsion stability is achieved at pH 3.0 and above, and it is preferred to use a pH of from 4.0 to 7.0.

It is desired to point out that the rapid curing systems employed herein which cure so well at the moderate conditions and rapid treatments involved in normal size press operation are unstable and must be used relatively soon after formulation. In typical practice in this invention, a pot life of about 8 hours is obtained. This useful period can be extended by cooling the mixture or by adding ammonia or other volatile amine or fugitive inhibitor which increases the pot life.

The mixtures of this invention are preferably assembled in a manner which uniformly disperses the acid catalyst in the size while preventing excessive localized concentrations of acid catalyst from contacting the aminoplast resin, and especially from contactng the emulsion copolymer while the aminoplast is present. Excessive concentrations of acid produce localized instability. When the water which is added to dilute the size composition is mixed with the aminoplast resin before the acid catalyst is added to it, and the aqueous emulsion is added last to complete the mixture, this minimizes localized instability. It is stressed that one cannot simply mix all the materials together in the absence of the acid catalyst and then add that catalyst when desired, for that would cause the localized instability under consideration.

The hydroxy number of the emulsion copolymer is also important, and it is preferred that sufficient hydroxy-functional monomer, illustrated by 2-hydroxyethyl acrylate, be used to provide a hydroxy number of at least about 40. The maximum hydroxy number is not critical and is primarily limited by having a large enough proportion of non-reactive monomers to produce the water insolubility and desired glass transition temperature in the copolymer which is formed. On this basis, the maximum hydroxy number can be generally estimated at about 300, but preferred copolymers have an hydroxy number up to about 200.

The preferred glass transition temperature, commonly abreviated $T_g$, is in the range of −10° C. to 30° C.

The hydroxy monomers which may be used are preferably illustrated by 2-hydroxyethyl acrylate and 2-hydroxyethyl methacrylate, for these are inexpensive, available and provide the hydroxy group as a primary hydroxy group. On the other hand, the hydroxy group may, less desirably, be a secondary hydroxy group, as is provided by 2-hydroxypropyl acrylate or 2-hydroxybutyl acrylate or the corresponding methacrylates. Moreover, hydroxy-functional esters of other copolymerizable monoethylenically unsaturated acids can be used, such as crotonic acid, maleic acid or fumaric acid, and ethers of copolymerizable monoethylenically unsaturated alcohols, like allyl alcohol, are also broadly useful herein.

The balance of the monomers which are used in the formation of the aqueous emulsion copolymer are monoethylenically unsaturated and are preferably non-reactive, which term defines monomers which are reactive only through their single ethylenic unsaturation under normal conditions of copolymerization and contemplated cure under the conditions noted previously. These monomers are illustrated by methyl methacrylate, ethyl acrylate, n-butyl or isobutyl acrylate or methacrylate, vinyl acetate, and the like, and they are normally used in an amount of at least about 50% of the total monomers subjected to copolymerization. Styrene is a particularly preferred monomer which is present in an amount of about 30% to about 70%, usually in combination with another monomer of lower $T_g$, such as ethyl acrylate or a butyl acrylate, to bring the copolymer into the preferred range of $T_g$.

The copolymers which are used are made by aqueous emulsion copolymerization, and are commonly described as emulsion copolymers. They are produced by conventional copolymerization in aqueous emulsion, usually involving a redox polymerization, to provide a high molecular weight copolymer which is easily cured to provide a solvent-resistant finish. Solvent resistance is usually checked by rubbing with methyl ethyl ketone solvent, and resistance to removal by 10 double rubs with a ketone-saturated cloth identies the solvent resistance which is needed.

The copolymerization, unlike that required in U.S. Pat. No. 4,609,589, is carried out in the presence of enough surfactant (soap) to maintain the emulsion during the copolymerization and thereafter. The preferred surfactants are usually a mixture of a nonionic surfactant and an anionic surfactant, but this is not essential. This is a common surfactant system for aqueous emulsion copolymerizations, and it will be further illustrated in the Example.

The anionic surfactant is particularly helpful in obtaining fine particle size which is preferred in this invention. An average particle size in the range of 50–250 nm (nanometers) is desired, preferably from 80–130 nm. The particle size which will be illustrated in 130 nm, albeit there are indications (not fully evaluated) that even finer particle size might be better.

The emulsions which are produced may vary in solids content, but are usually in the range of 30% to 50%. These emulsions are diluted with water to form the size press compositions, and usually have a solids content of from 15% to 40%, preferably from 25% to 35%.

In particularly preferred practice, clay platelets are added to fill the composition. Delaminated clay serves this function and is usually used in a pigment to binder weight ratio of 0.5:1 to 1:0.5. While the identified clay is preferred, other inert fillers are generally useful, albeit fillers which are reactive with the materials used herein should be avoided.

Throughout this application, and in the accompanying examples and claims, all proportions are by weight, unless otherwise stated.

The invention is illustrated in the Examples which follow.

EXAMPLE 1

A pre-emulsion was prepared from 340 grams of water, 7.5 grams of a sodium dodecylbenzene sulfonate anionic surfactant (Siponate DS-10 may be used), 21.4 grams of a polyethoxylated isooctylphenol containing 40 moles of adducted ethylene oxide per mole of the phenol (Triton X-405 from Rohm and Haas, Philadelphia PA may be used), 100 grams of 2-hydroxyethyl acrylate, 150 grams of n-butyl acrylate, and 250 grams of styrene. A stirred reactor vessel was charged with 330 grams of water, 0.01 gram of ferrous sulfate heptahydrate and 50 grams of the previously described pre-emulsion. The reactor contents were maintained between 60° and 63° C. while the balance of the pre-emulsion was metered into the reactor over 140 minutes along with a solution of 1.25 grams of sodium formaldehyde sulfoxylate in 30 grams of water and a solution of 1.25 grams of t-butylhydroperoxide in 30 grams of water. Addition of the sodium formaldehyde sulfoxylate solution and the t-butylhydroperoxide solution was started 10 minutes prior and continued 30 minutes after the pre-emulsion addition.

It is desired to point out that the sodium formaldehyde sulfoxylate introduces a source of acid into the copolymerization, and the slower the addition of pre-emulsion and the longer the elevated temperature needed for copolymerization is maintained, the higher the pH of the copolymer emulsion which is produced, albeit the reason for this is not clear.

The emulsion copolymer product produced as above described had a solids content of 41.5%, a pH of 2.9, a viscosity of 90 centipoises and had a particle size of 119 nanometers. This product was acceptable for use in this invention, but slightly too acidic for commercially acceptable stability.

Repeating the above procedure, but adding the pre-emulsion over 180 minutes to slow the process yielded a preferred product with a pH between 4 and 5 and a particle size of 130 nanometers. This is the product used in the remaining examples.

EXAMPLE 2

A thermosetting size composition is provided by appropriately mixing 6.2 pounds of methylated urea formaldehyde resin (100% solids), 1.4 pounds of acid catalyst (dodecylbenzene sulfonic acid) and 100.0 pounds of the resin emulsion of Example 1 (about 41% solids). Half of the water needed to dilute the composition to 30% solids is added to the urea resin and mixed until a uniform solution is obtained. Then the remaining water needed for dilution is mixed into the diluted urea resin solution. Then, the acid catalyst is stirred in until uniform and the resin emulsion is added to this dilute solution of urea resin and acid catalyst.

EXAMPLE 3

The composition set forth in Example 2 can be used as such, or it can be further compounded by the addition of fillers, such as clay. To illustrate the addition of fillers, 46 pounds of delaminated clay are added to the unpigmented mixture described in Example 2 and mixed in. The pot life is unaffected by the addition of the clay, and the cure speed is about the same.

What is claimed is:

1. A thermosetting size applyable to paper in a size press and curable at a temperature not in excess of about 260° F. for 10 seconds, said size comprising an aqueous emulsion comprising water having suspended therein: (1) aqueous emulsion copolymer particles of monoethylenically unsaturated monomers comprising hydroxy-functional monomer, said copolymer having an hydroxy number of from about 40 up to about 300, and the balance of said monomers providing a water insoluble polymer having a glass transition temperature of from about −20° C. to about 50° C., said emulsion having a pH greater that about 2.5 up to about 7; (2) a stoichiometric deficiency of an aminoplast cross-linking agent providing a ratio of hydroxy groups to N-methylol curing groups of from 4:1 to 1.2:1; and (3) an acid curing catalyst uniformly distributed in said size.

2. A thermosetting size as recited in claim 1 in which said emulsion copolymer has an hydroxy number of at least 40 and said ratio of hydroxy groups to curing groups is from 2.5:1 to 1.5:1.

3. A thermosetting size as recited in claim 2 in which said aminoplast cross-linking agent is a urea-formaldehyde resin.

4. A thermosetting size as recited in claim 1 in which said emulsion has a pH in the range of pH 3.0 to 7.0 and said size has a solids content of from 15% to 40%.

5. A thermosetting size as recited in claim 3 in which said emulsion has a pH in the range of pH 4.0 to 7.0 and said size has a solids content of from 25% to 35%.

6. A thermosetting size as recited in claim 1 in which said hydroxy monomer is used in an amount to provide a hydroxy number of from about 75 to about 200.

7. A thermosetting size as recited in claim 1 in which said hydroxy monomer carries a primary hydroxy group.

8. A thermosetting size as recited in claim 7 in which said hydroxy monomer is 2-hydroxyethyl acrylate or methacrylate.

9. A thermosetting size as recited in claim 1 in which said emulsion copolymer has a glass transition temperature in the range of −10° C. to 30° C.

10. A thermosetting size as recited in claim 1 in which at least 50% of said copolymer is constituted by nonreactive monoethylenic monomers.

11. A thermosetting size as recited in claim 10 in which from 30% to 70% of said copolymer is constituted by styrene.

12. A thermosetting size as recited in claim 1 in which said emulsion copolymer is suspended by surfactants comprising anionic surfactant.

13. A thermosetting size as recited in claim 1 in which said copolymer particles have an average particle size in the range of 50–250 nanometers.

14. A thermosetting size as recited in claim 13 in which said copolymer particles have an average particle size in the range of 80–130 nanometers.

15. A thermosetting size as recited in claim 1 in which said aqueous emulsion copolymer is formed by copolymerization in the presence of surfactants by redox polymerization.

16. A thermosetting size as recited in claim 1 in which said size is pigmented with clay.

17. A thermosetting size as recited in claim 1 in which said acid curing catalyst is used in an amount less than about 20% of the weight of said aminoplast curing agent.

18. A thermosetting size as recited in claim 1 in which said size is pigmented with delaminated clay in a pigment to binder weight ratio of 0.5:1 to 1:0.5.

19. Paper size-coated with the thermosetting size recited in claim 1, said size being thermoset by the conditions used to dry said paper.

20. Size-coated paper as recited in claim 18 in which said size is applied and cured in an in-line size press operation.

21. Release paper comprising the size-coated paper of claim 18 overcoated with a release layer adhered to said thermoset size coating.

22. A method of providing a rapid curing thermosetting size press composition applyable to paper in a size press and curable at a temperature not in excess of about 280° F. for 10 seconds, comprising the steps of:

(A) adding the water needed to dilute the final size composition to a solids content of from 15% to 40% to an aminoplast resin cross-linking agent used in an amount defined hereinafter;

(B) adding an acid catalyst to the diluted aminoplast resin to provide an acid catalyst-containing mixture; and (C) adding an aqueous emulsion of aqueous emulsion copolymer particles to said acid catalyst-containing mixture to uniformly distribute said acid catalyst in said size composition, said emulsion copolymer particles being a copolymer of monoethylenically unsaturated monomers comprising hydroxy-functional monomer, said copolymer having an hydroxy number of from about 40 up to about 300, and the balance of said monomers providing a water insoluble polymer having a glass transition temperature of from about −20° C. to about 50° C., said emulsion having a pH greater that about 2.5 up to about 7, and said aminoplast cross-linking agent providing a ratio of hydroxy groups to N-methylol curing groups of from 4:1 to 1.2:1.

* * * * *